US007766706B2

(12) United States Patent
Kawamura et al.

(10) Patent No.: US 7,766,706 B2
(45) Date of Patent: Aug. 3, 2010

(54) FEMALE TERMINAL ASSEMBLY WITH COMPRESSION CLIP

(75) Inventors: Makiko Kawamura, Farmington Hills, MI (US); Ping Chen, West Bloomfield Hills, MI (US)

(73) Assignee: J. S. T. Corporation, Farmington Hills, MI (US)

( * ) Notice: Subject to any disclaimer, the term of this patent is extended or adjusted under 35 U.S.C. 154(b) by 0 days.

(21) Appl. No.: 12/272,047

(22) Filed: Nov. 17, 2008

(65) Prior Publication Data

US 2010/0124857 A1 May 20, 2010

(51) Int. Cl.
*H01R 4/48* (2006.01)
*H01R 13/15* (2006.01)

(52) U.S. Cl. ..... 439/839; 439/833

(58) Field of Classification Search ..... 439/839, 439/849, 833, 850, 845, 847, 856, 832; 200/254, 200/282

See application file for complete search history.

(56) References Cited

U.S. PATENT DOCUMENTS 1,940,942 A * 12/1933 Dohrwardt ..... 439/250
2,292,320 A * 8/1942 Hammerly ..... 439/833
3,713,080 A 1/1973 Kennedy
4,834,678 A 5/1989 Emadi et al.
5,540,603 A 7/1996 Fujiwara
5,868,590 A * 2/1999 Dobbelaere ..... 439/839
6,692,316 B2 * 2/2004 Hsieh et al. ..... 439/845
6,722,926 B2 * 4/2004 Chevassus-More ..... 439/721
7,581,972 B2 * 9/2009 Daamen ..... 439/249

OTHER PUBLICATIONS

PCT/ISA/220, App. No. PCT/US09/64592, Dec. 7, 2009 (2 pages).
PCT/ISA/210 International Search Report (2 pages), Dec. 7 2009.
PCT/ISA/237, Written Opinion (5 pages), Dec. 7 . 2009.

* cited by examiner

*Primary Examiner*—Hae Moon Hyeon
(74) *Attorney, Agent, or Firm*—Rader, Fishman & Grauer PLLC

(57) ABSTRACT

A female terminal assembly includes a core terminal part and a generally U-shaped clip part. The core terminal part is fabricated from an electrically-conductive material and includes a generally U-shaped channel member. The generally-U-shaped channel member defines a generally U-shaped channel extending therethough and an opening into the generally U-shaped channel by a pair of side members interconnected together by a base member. The generally U-shaped clip part is fabricated from a stiff yet resilient material and includes a generally U-shaped clip part channel member defining a generally U-shaped clip part channel. The generally U-shaped clip part is sized to substantially cover the generally U-shaped channel member and is operative to apply opposing compression forces to generally the pair of side members of the U-shaped channel member urging the pair of side members towards each other and into the generally U-shaped channel.

27 Claims, 17 Drawing Sheets

FEMALE TERMINAL ASSEMBLY WITH COMPRESSION CLIP

FIELD OF THE INVENTION

The present invention relates to an electrical female terminal. More particularly, the present invention is directed to an electrical female terminal assembly.

BACKGROUND OF THE INVENTION

Electrical female terminals are well known in the industry. For example, U.S. Pat. No. 3,713,080 to Kennedy discloses a female electrical terminal for receiving a male blade terminal. This female terminal include first, second, third and fourth walls which are joined together into an integral unit at their edges between the first and the second, the second and the third, and the third and the fourth walls. A cooperable lock device is formed, in part, on a free end of the first wall and, in part, on a free end of the fourth wall. The cooperable lock device locks the walls into a closed configuration to define therein an interior volume in which the first and the third walls are in a facing relationship and the second and the fourth walls are in a facing relationship. Individual ones of a pair of terminal elements are formed integrally from respective ones of a pair of facing walls. Each of the terminal elements is folded back from its point of attachment to the wall into the interior volume of the terminal to form at a main blade terminal contacting portion which is resiliently deflectable when engaged by an inserted male blade terminal.

This female terminal requires two completely independent spring elements operative within the interior volume. In practice, this female terminal is particularly useful as a small female terminal. Further, the female terminal is typically used for low electrical current applications.

In U.S. Pat. No. 5,540,603 to Fujiwara, a female contact is disclosed that has highly-precise, anti-overstress protrusions which are resistant to deformation caused by excessive external forces. The protrusions protect a spring-loaded contacting section from overstress and are located between a bottom wall and the spring-loaded contacting section which extends backward from a front end of the bottom wall. The protrusions are formed by bending a portion inwardly of the side walls between two slits formed therein. Since the protrusions are V-shaped with both ends fixed at the walls, the protrusions are generally not subject to deformation caused by external forces.

U.S. Pat. No. 4,834,678 to Emadi et al. discloses a kit for assembling an electrical connector for high voltage connections. The kit has only a pin contact terminal crimpable to a stripped conductor wire, a socket contact terminal crimpable to a stripped conductor wire, a terminal housing subassembly into which the crimped pin contact terminal is insertable, a terminal housing subassembly into which the crimped socket contact terminal is insertable, and connector housings having passageways into which the housing subassemblies are insertable. Each housing subassembly includes a rearward section extending rearwardly from the termination of the stripped conductor wire to the terminal and along a length of the insulated conductor to establish a long voltage leakage path for minimizing corona discharge events during in-service use. Each housing subassembly contains a retention clip therewithin to secure the terminal upon insertion and includes another retention clip therearound to retain the housing subassembly within the connector housing upon insertion into a housing passageway. The housing subassemblies include matable forward hood sections surrounding the pin and socket contact sections and establishing a long voltage leakage path along the connector mating face.

Although this female terminal is used for high voltage applications, it does not accept male blade terminals.

It would be beneficial to provide a female terminal assembly that accepts male blade terminals and is particularly useful for high voltage applications. The present invention provides these benefits.

OBJECTS AND SUMMARY OF THE INVENTION

It is an object of the invention to provide a female terminal assembly that accepts male blade terminals.

It is another object of the invention to provide a female terminal assembly that is particularly useful for high voltage applications.

In summary, a female terminal assembly of the present invention includes a core terminal part and a generally U-shaped clip part. The core terminal part is fabricated from an electrically-conductive material such as metal and includes a generally U-shaped channel member. The generally-U-shaped channel member defines a generally U-shaped channel extending therethough. The generally U-shaped channel member has a base member and a pair of side members that extend generally parallel to one another. The pair of side members are disposed apart from one another and are connected to the base member to terminate in respective side member end portions. The respective side member end portions define an opening into the generally U-shaped channel. The opening facially opposes the base member. The generally U-shaped clip part is fabricated from a stiff yet resilient material and includes a generally U-shaped clip part channel member. The generally U-shaped clip part channel member defines a generally U-shaped clip part channel that extends through the generally U-shaped clip part channel member. The generally U-shaped clip part is sized to substantially cover the generally U-shaped channel member and is operative to apply opposing compression forces to the respective side member end portions thereby urging the pair of side members towards each other and into the generally U-shaped channel.

These objects and other advantages of the present invention will be better appreciated in view of the detailed description of the exemplary embodiments of the present invention with reference to the accompanying drawings, in which:

DETAILED DESCRIPTION OF THE EXEMPLARY EMBODIMENTS

Hereinafter, embodiments of the present invention will be described with reference to the attached drawings. The structural components common to those of the prior art and the structural components common to respective embodiments of the present invention will be represented by the same symbols and repeated description thereof will be omitted.

Figure 1:
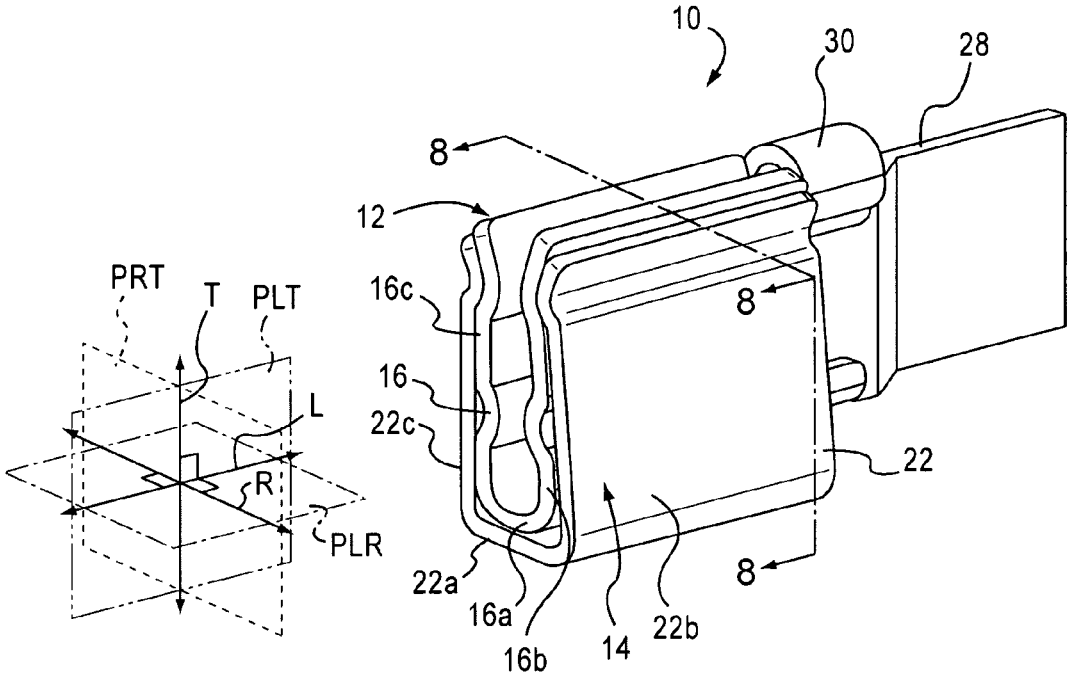
FIG. 1 is a perspective view of a first exemplary embodiment of a female terminal assembly of the present invention illustrating a core terminal part and a generally U-shaped clip part releasably connected to each other.
Figure 2:
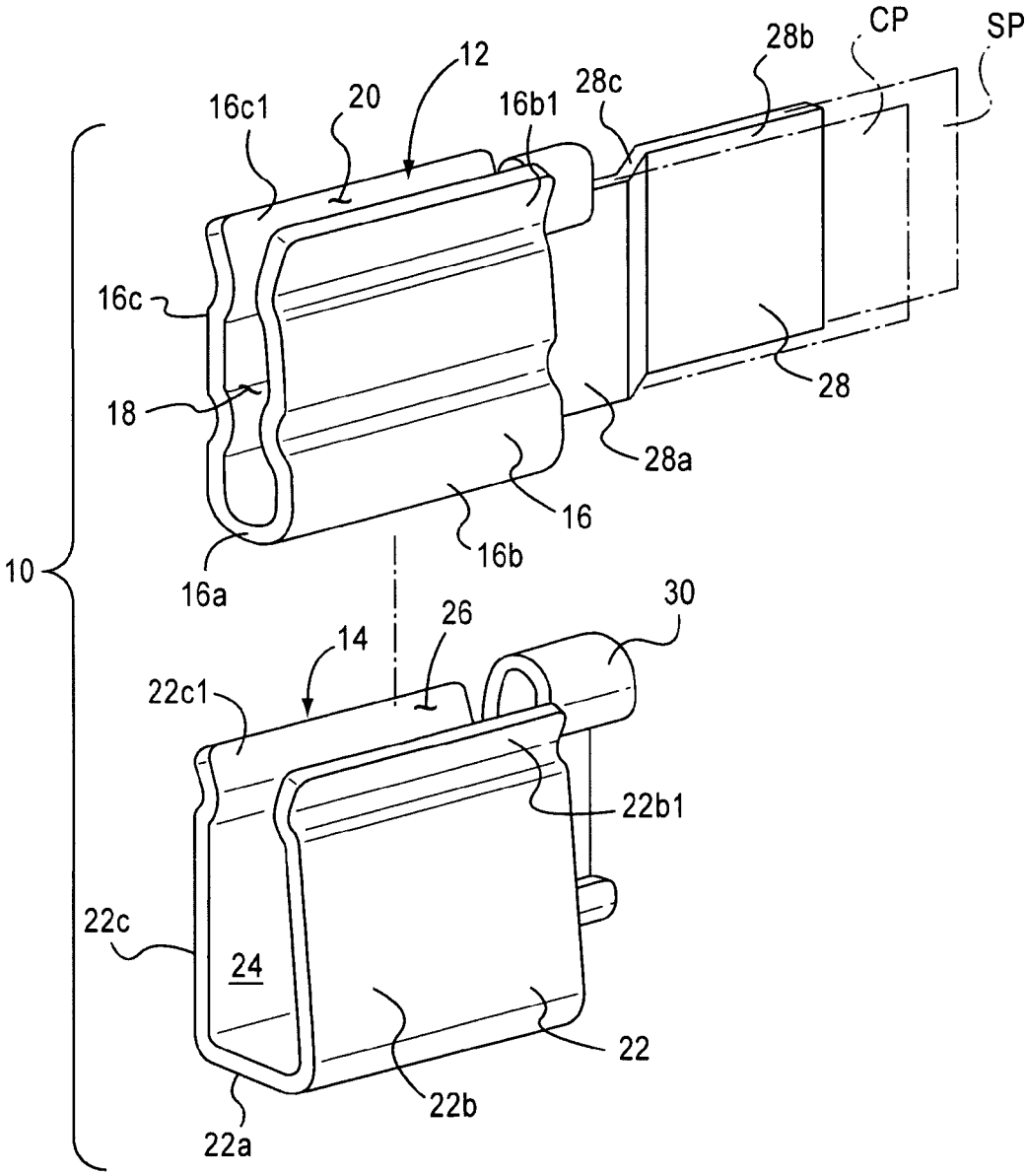
FIG. 2 is an exploded perspective view of the first exemplary embodiment of the female terminal assembly of the present invention illustrating the core terminal part and the generally U-shaped clip part disengaged from one another.
Figure 3:
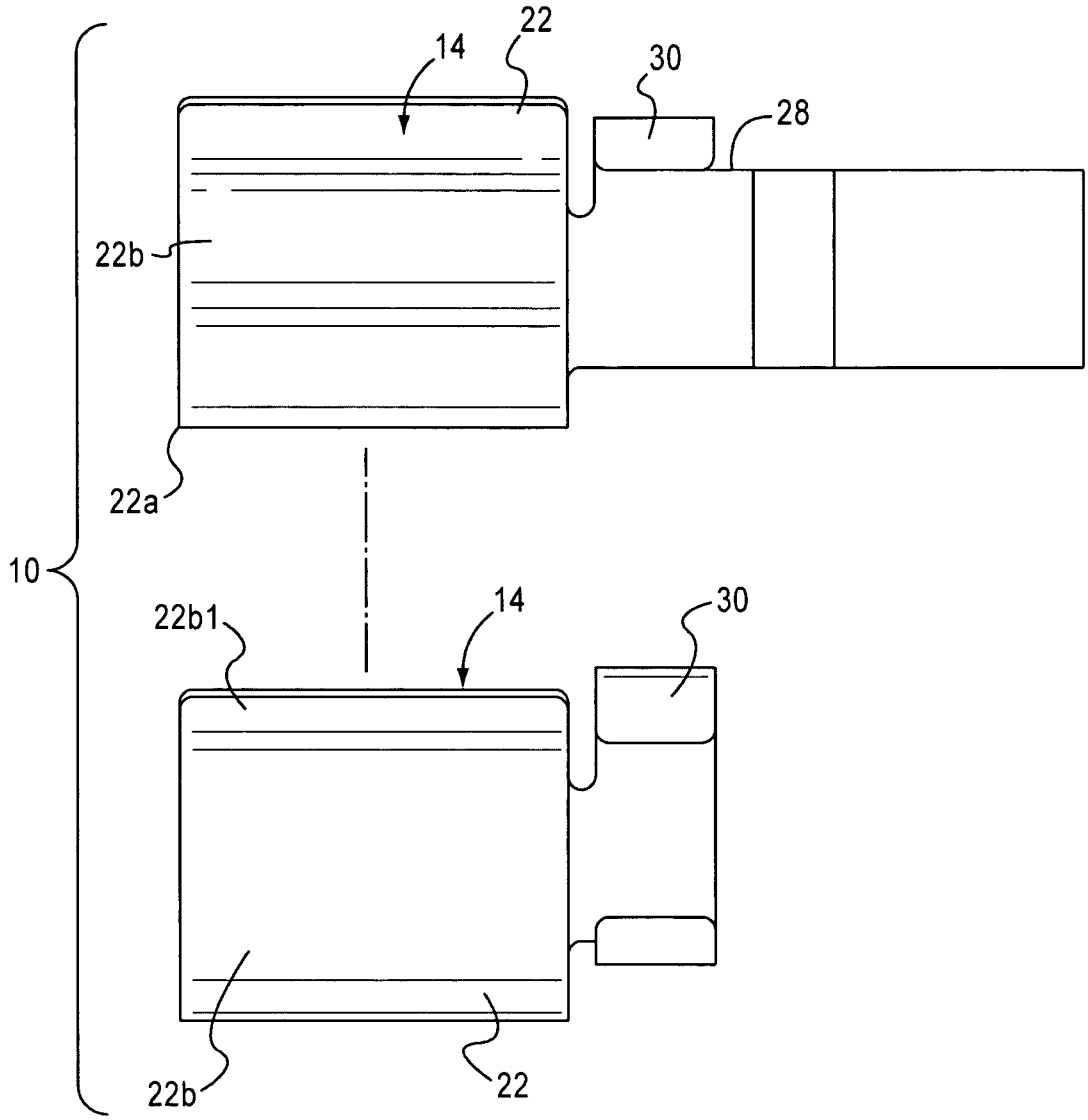
FIG. 3 is a side elevation view of the female terminal assembly of the present invention in FIG. 2.
Figure 4:
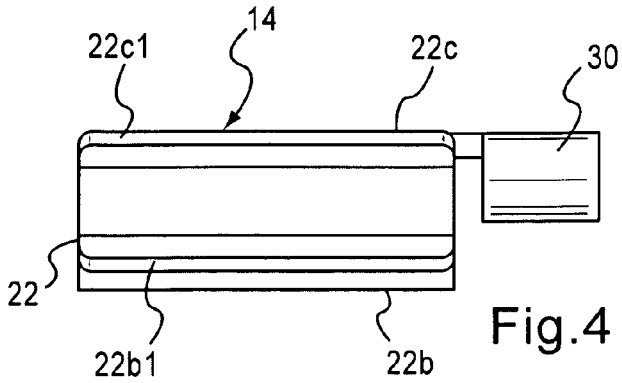
FIG. 4 is a top plan view of the core terminal part of the first exemplary embodiment of the female terminal assembly of the present invention.
Figure 5:
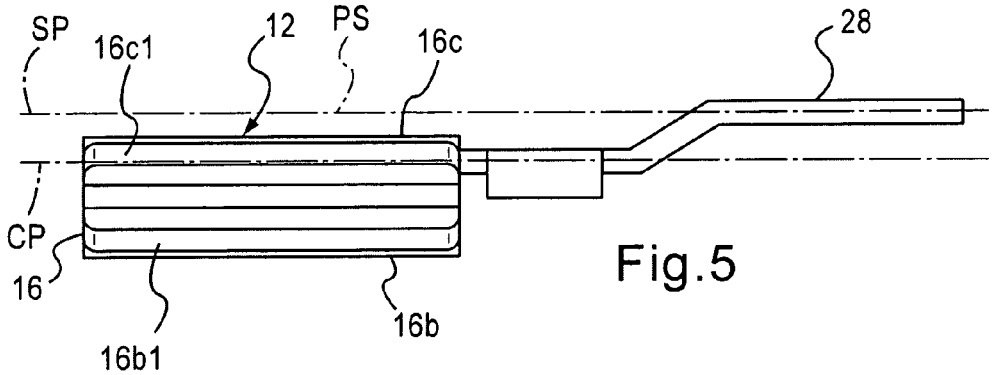
FIG. 5 is a top plan view of the generally U-shaped clip part of the first exemplary embodiment of the female terminal assembly of the present invention.

A first exemplary embodiment of a female terminal assembly 10 of the present invention is hereinafter described with reference to FIGS. 1-11. As best shown in FIGS. 1-3, the female terminal assembly 10 of the present invention includes a core terminal part 12 and a generally U-shaped clip part 14 oriented along and about a conventional Cartesian coordinate system. As is known in the art, the conventional Cartesian coordinate system includes a longitudinal axis L, a lateral axis R and a transverse axis T. As is known in the art and as shown in FIG. 1, the longitudinal axis L, the lateral axis R and the transverse axis T perpendicularly intersect one another and the longitudinal axis L and the lateral axis R form a longitudinal/lateral plane PLR, the longitudinal axis L and the transverse axis R form a longitudinal/transverse plane PLT and the lateral axis and the transverse axis form a lateral/transverse plane PRT.

Figure 8:
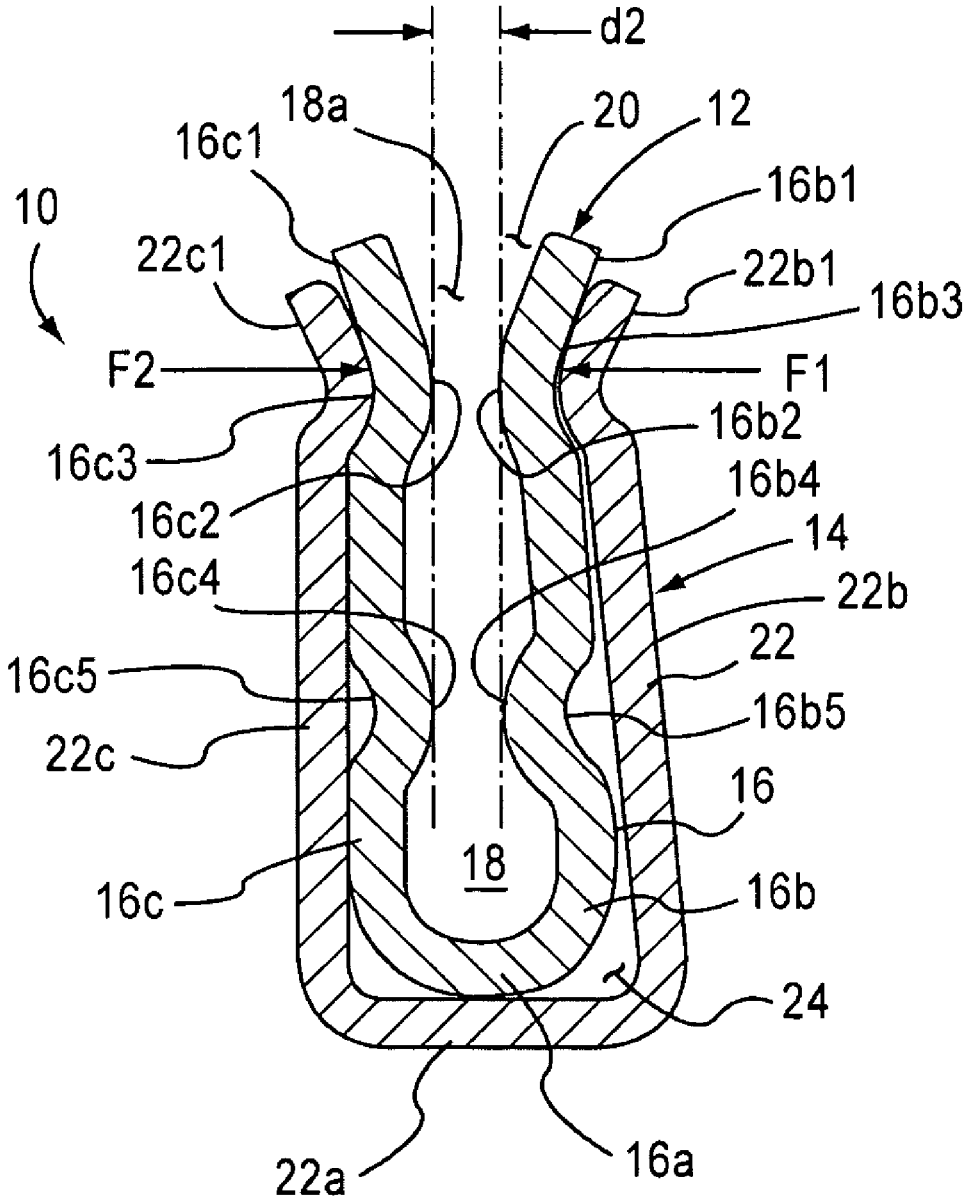
FIG. 8 is an enlarged side elevational view of the core terminal part and the generally U-shaped clip part releasably connected to each other of the first exemplary embodiment of the female terminal assembly.
Figure 11:
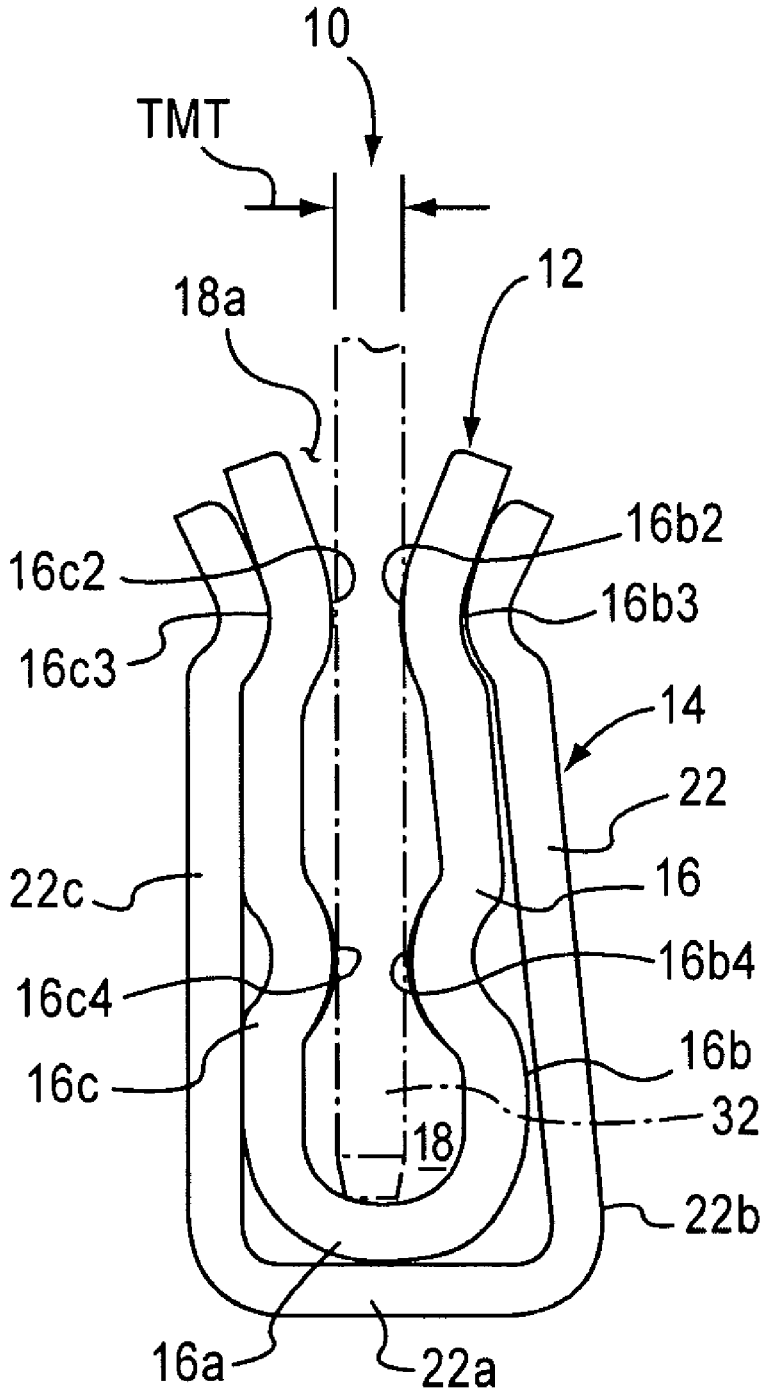
FIG. 11 is an enlarged side elevational view of the core terminal part and the generally U-shaped clip part releasably connected to each other of the first exemplary embodiment of the female terminal assembly with the conventional male terminal blade drawn in phantom received therein.
Figure 12:
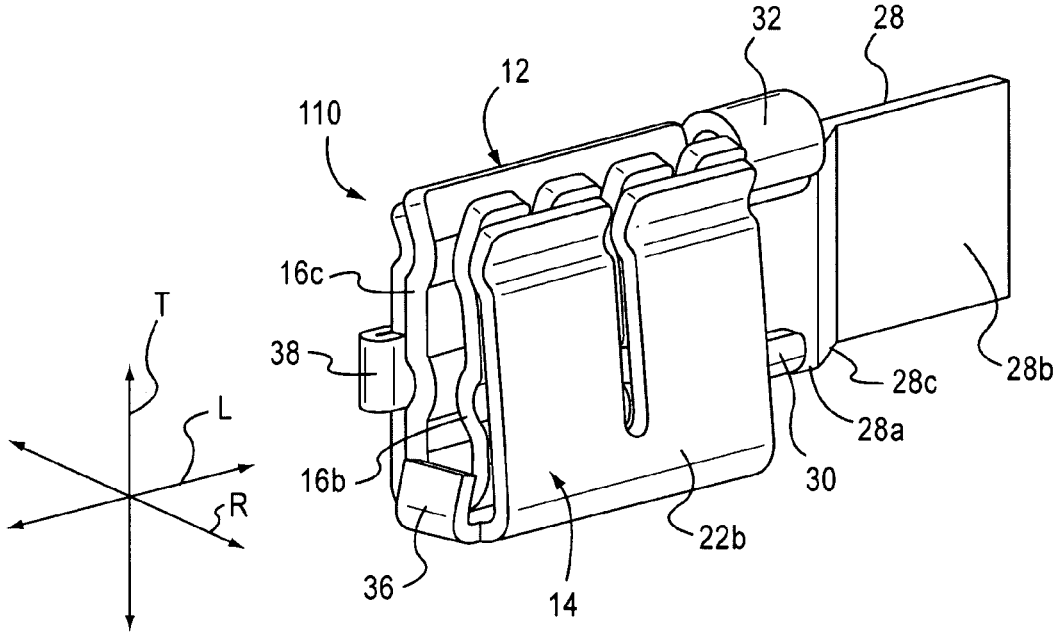
FIG. 12 is a perspective view of a second exemplary embodiment of the female terminal assembly of the present invention illustrating a core terminal part and a generally U-shaped clip part releasably connected to each other.
Figure 13:
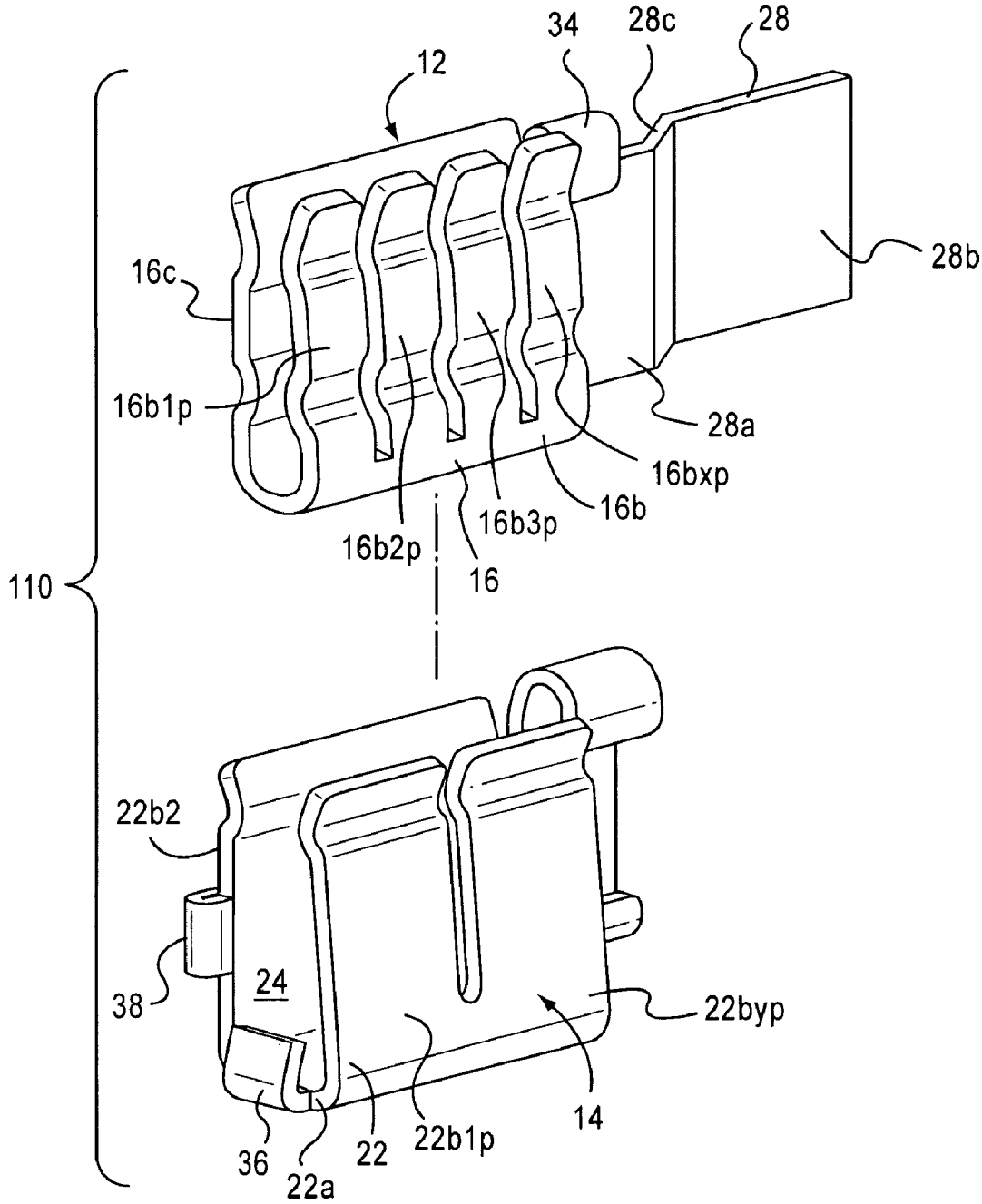
FIG. 13 is an exploded perspective view of the second exemplary embodiment of the female terminal assembly of the present invention illustrating the core terminal part and the generally U-shaped clip part disengaged from one another.
Figure 14:
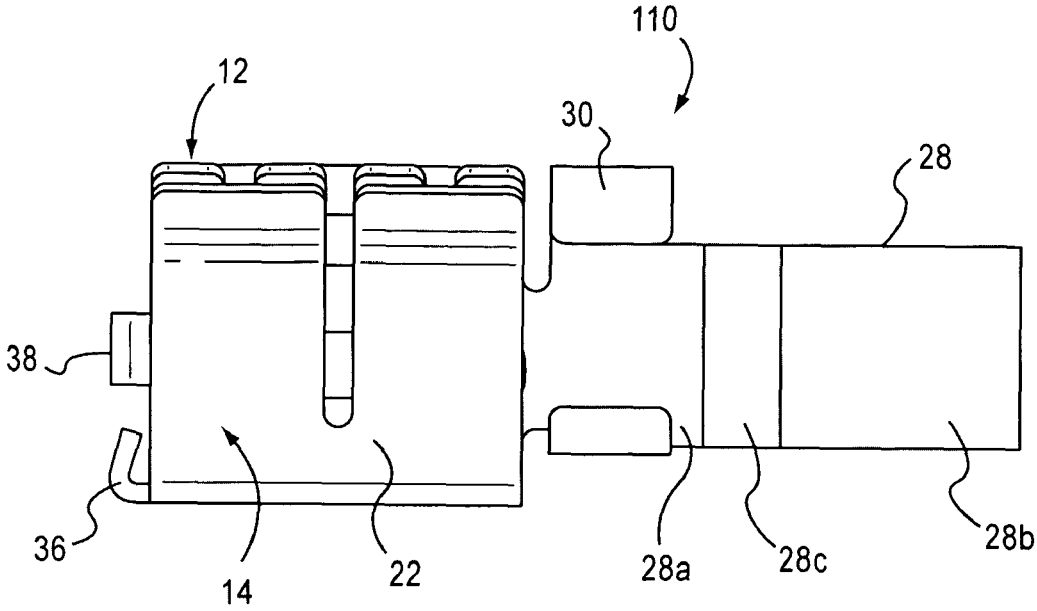
FIG. 14 is a side elevation view of the second exemplary embodiment of the female terminal assembly of the present invention in FIG. 12.
Figure 15:
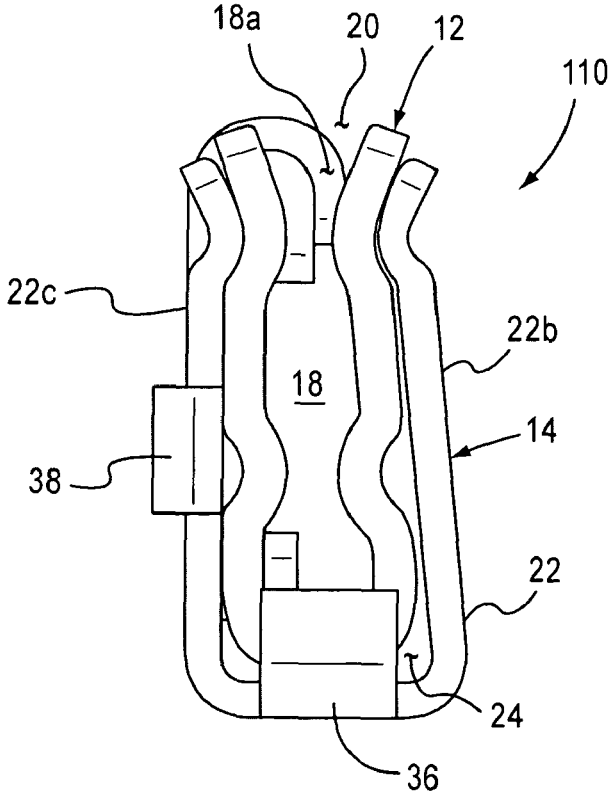
FIG. 15 is an enlarged side elevational view of the core terminal part and the generally U-shaped clip part releasably connected to each other of the second exemplary embodiment of the female terminal assembly of the present invention.

The core terminal part 12 is fabricated from an electrically-conductive material such as copper or some other conventional electrically-conductive metal as shown in FIGS. 8 and 11. As best shown in FIG. 2, the core terminal part 12 includes a longitudinally-extending generally U-shaped channel member 16 that defines a longitudinally-extending generally U-shaped channel 18. The generally U-shaped channel member 16 has a base member 16*a* extending longitudinally and laterally and a pair of side members 16*b* and 16*c* extending longitudinally and transversely. The pair of side members 16*b* and 16*c* also extend generally parallel to one another and are disposed laterally apart from one another a first distance d1 as best shown in FIG. 8. The pair of side members 16*b* and 16*c* are connected longitudinally along the base member 16*a* and extend transversely therefrom to terminate in respective side member end portions 16*b*1 and 16*c*1. The respective side member end portions 16*b*1 and 16*c*1 define a longitudinally and laterally extending opening 20 into the generally U-shaped channel 18 such that the opening 20 facially opposes the base member 16*a*.

With reference to FIGS. 1, 2, and 8, the generally U-shaped clip part 14 is fabricated from a stiff yet resilient material such as, for example, metal. However, one of ordinary skill in the art would appreciate that the generally U-shaped clip part 14 could be manufactured from other stiff yet resilient non-metal materials such as, for example, plastic. The generally U-shaped clip part 14 includes a longitudinally-extending generally U-shaped clip part channel member 22 that defines a longitudinally-extending generally U-shaped clip part channel 24. With reference to FIGS. 1 and 8, the generally U-shaped clip part 14 is sized to substantially cover the generally U-shaped channel member 16 and is operative to apply opposing compression forces F1 and F2 (FIG. 8) to the respective side member end portions 16*b*1 and 16*c*1 thereby urging the pair of side members 16*b* and 16*c* towards each other and into the generally U-shaped channel 18.

Figure 6:
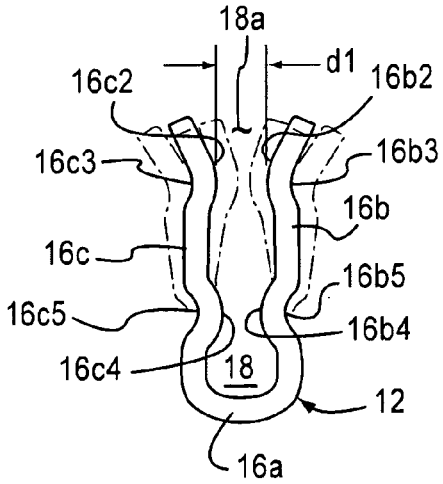
FIG. 6 is a side elevational view of a generally U-shaped channel member of the core terminal part of the first exemplary embodiment of the female terminal assembly where respective ones of a pair of side members move from a normal state to an outwardly flexed state (phantomly drawn) and from the normal state to an inwardly flexed state (phantomly drawn) with the respective ones of the pair of side members being resiliently biased to the normal state.

With reference to FIG. 6, respective ones of the pair of side members 16*b*1 and 16*c*1 move from a normal state (solid lines) to an outwardly flexed state (represented by the phantomly drawn lines spreading outwardly from the generally U-shaped channel 18). Also, respective ones of the pair of side members 16*b*1 and 16*c*1 move from a normal state (solid lines) to an inwardly flexed state (represented by the phantomly drawn lines spreading inwardly into the generally U-shaped channel 18). Further, it is noted that the respective ones of the pair of side members 16*b*1 and 16*c*1 are resiliently biased to the normal state.

Figure 7:
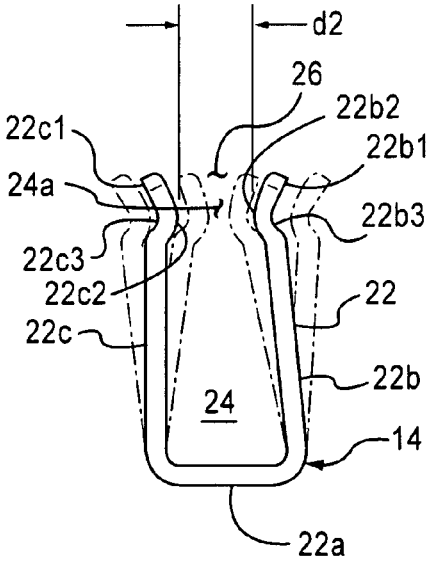
FIG. 7 is a side elevational view of a generally U-shaped clip part channel member of the generally U-shaped clip part of the first exemplary embodiment of the female terminal assembly where respective ones of a pair of clip part side members move from a normal condition to an outwardly flexed condition (phantomly drawn) and from the normal condition state to an inwardly flexed condition (phantomly drawn) with the respective ones of the pair of clip part side members being resiliently biased to the normal condition.

Again, with reference to FIGS. 1, 2 and 8, the generally U-shaped clip part channel member 22 is sized to receive the generally U-shaped channel member 16 in a close-fitting relationship. The generally U-shaped clip part channel member 22 includes a clip part base member 22*a* and a pair of clip part side members 22*b* and 22*c* disposed apart from one another and connected to the clip part base member 22*a* to terminate in respective clip part side member end portions 22*b*1 and 22*c*1. As best shown in FIGS. 2 and 7, the clip part side member end portions 22*b*1 and 22*c*1 define a clip part opening 26 into the generally U-shaped clip part channel 24. The clip part opening 26 facially opposes the clip part base member 22*a*. As shown in FIG. 7, respective ones of the pair of clip part side members 22*b* and 22*c* move from a normal condition (solid line) to an outwardly flexed condition (represented by the phantomly drawn lines spreading outwardly from the generally U-shaped clip part channel 24). Also, respective ones of the pair of clip part side members 22*b* and 22*c* move from the normal condition (solid line) to an inwardly flexed condition (represented by the phantomly drawn lines spreading inwardly into the generally U-shaped clip part channel 24). The respective ones of the pair of clip part side members 22*b* and 22*c* are resiliently biased to the normal condition.

As best shown in FIGS. 1-3, 9 and 10, the core terminal part 12 also includes an attachment member 28 that is connected to one of the pair of side members, for example, side member 16*c*. With reference to FIGS. 1-4, the generally U-shaped clip part includes a C-clamp piece 30. Although not by way of limitation but by example only, the C-clamp piece 30 is connected to one of the pair of clip part side members, for example, clip part side member 22*c*. The C-clamp piece 30 is sized and operative to clamp onto the attachment member 28 to assist in securing the generally U-shaped clip part 14 onto the core terminal part 12.

By way of example only in FIGS. 1-3, 8 and 10, the attachment member 28 includes a first panel 28*a* connected to one of the pair of side members, namely in this instance, side member 16*c*. The attachment member 28 is disposed in a common plane CP as best shown in FIGS. 2 and 3 with side member 16*c*. Further, the attachment member 28 includes a second panel 28*b* and an intermediate panel 28*c* that is disposed between and connected to the first and second panels 28*a* and 28*b* respectively. The second panel 28*b* is disposed in a second panel plane SP that extends parallel to the common plane CP. As best shown in FIGS. 2 and 3, the intermediate panel 28*c* interconnects the first and second panels 28*a* and 28*b* and extends obliquely relative to either one of the first and second panels 28*a* and 28*b*.

In FIGS. 5, 6, 8 and 11, each one of the pair of side members 16*b* and 16*c* includes a first protrusion 16*b*2 and 16*c*2 respectively. Each first protrusion 16*b*2 projects into the generally U-shaped channel 18 and each first protrusion 16*b*2 and 16*c*2 is disposed adjacent and extends parallel to the respective ones of the side member end portions 16*b*1 and 16*c*1. Further, each first protrusion 16*b*2 and 16*c*2 respectively forms a corresponding first recess 16*b*3 and 16*c*3. By way of example and best shown in FIG. 6, the first protrusion 16*b*2 of the side member 16*b* and the first protrusion 16*c*2 of the remaining one of the pair of side members 16*c* are facially opposed to and are disposed apart from each other by the distance d1. Also, in FIGS. 6, 8 and 11, each one of the pair of side members 16*b* and 16*c* includes a second protrusion 16*b*4 and 16*c*4. Each one of the second protrusions 16*b*4 and 16*c*4 projects into the generally U-shaped channel 18. Also, each one of the second protrusions 16*b*4 and 16*c*4 is disposed adjacent and extends parallel to the base member 16*a*. Additionally, each one of the second protrusions 16*b*4 and 16*c*4 forms a corresponding second recess 16*b*5 and 16*c*5. By way of example, the second protrusion 16*b*4 of the side member 16*b* and the second protrusion 16*c*4 of a remaining one of the side members 16*c* are facially opposed to and are disposed apart from each other.

Again, with reference to FIGS. 6, 8 and 11, each one of the pair of clip part side members 22*b* and 22*c* includes a clip part protrusion 22*b*2 and 22*c*2. Each clip part protrusion 22*b*2 and 22*c*2 projects into the generally U-shaped clip part channel 24. Respective ones of the clip part protrusions 22*b*2 and 22*c*2 are disposed adjacent and extend parallel to the respective ones of the clip part side member end portions 22*b*1 and 22*c*1. Also, respective ones of the clip part protrusion 22*b*2 and 22*c*2 form a corresponding clip part recess 22*b*3 and 22*c*3. Further, for example, the clip part protrusion 22*b*2 of clip part side member 22*b* and the clip part protrusion 22*c*2 of a remaining one of the pair of clip part side members 22*c* are facially opposed to and are disposed apart from each other a distance d2.

With the configuration of the core terminal part 12 and the generally U-shaped clip part 14 described above, one of ordinary skill in the art would appreciate that respective ones of the clip part protrusions 22*b*2 and 22*c*2 nestle into respective ones of the first recesses 16*b*3 and 16*c*3. Furthermore, as illustrated in FIGS. 8 and 11, the base member 16*a* and the clip part base member 22*a* contact each other. However, one of ordinary skill in the art would appreciate that the base member 16*a* and the clip part base member 22*a* can be disposed adjacent to each other.

As shown in FIG. 7, the respective clip part side member end portions 22*b*1 and 22*c*1 taper inwardly from the clip part opening 26 and towards each other into the generally U-shaped clip part channel 24 to form a generally V-shaped clip part channel portion 24*a* as viewed in cross-section. As shown in FIGS. 6, 8 and 11, the respective side member end portions 16*b*1 and 16*b*2 taper inwardly from the opening 20 and towards each other into the generally U-shaped channel to form a generally V-shaped channel portion 18*a* as viewed in cross-section.

Figure 9:
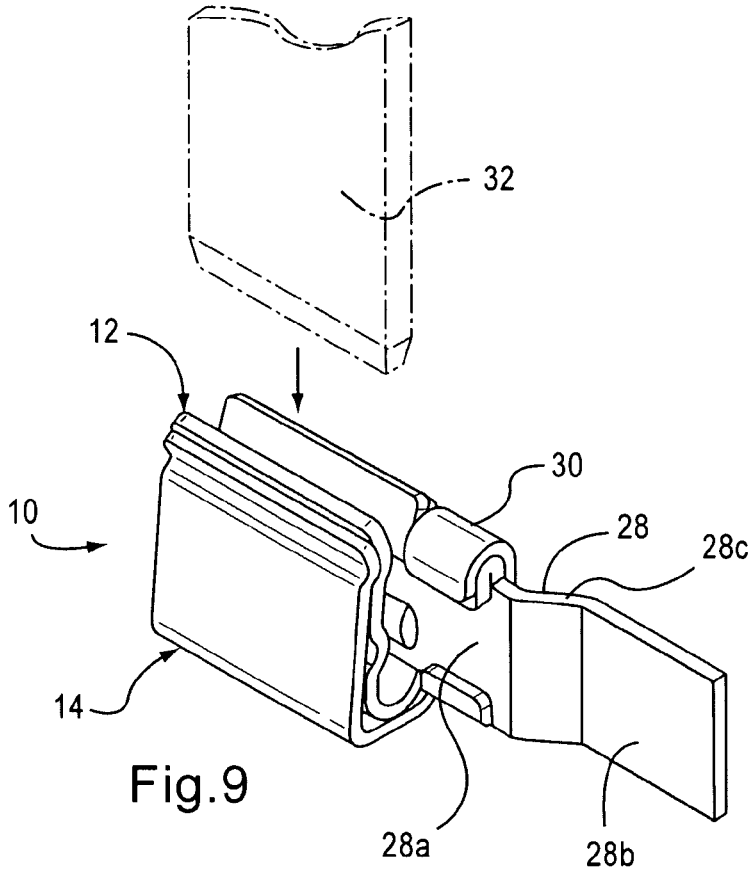
FIG. 9 is a reverse perspective view of the first exemplary embodiment of the female terminal assembly of the present invention illustrating the core terminal part and the generally U-shaped clip part releasably connected to each other just prior to receiving a conventional male terminal blade drawn in phantom.
Figure 10:
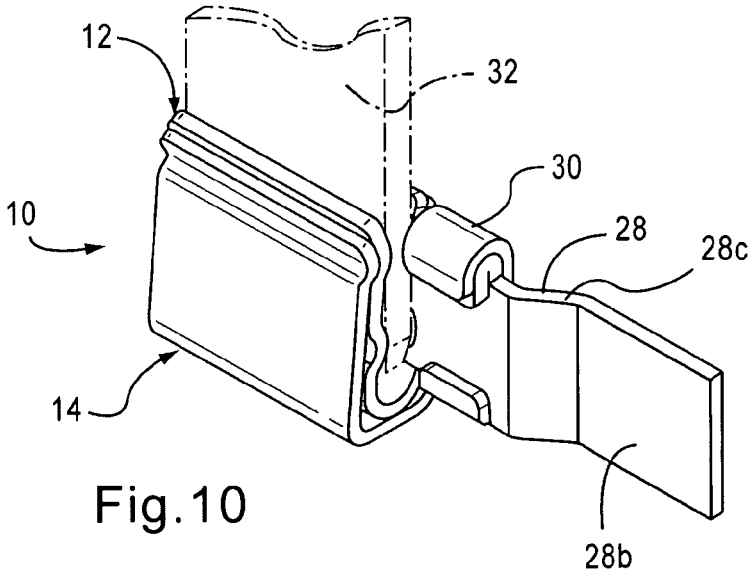
FIG. 10 is a reverse perspective view of the first exemplary embodiment of the female terminal assembly of the present invention illustrating the core terminal part and the generally U-shaped clip part releasably connected to each other with the conventional male terminal blade drawn in phantom received therein.

As illustrated in FIGS. 9-11, the female terminal assembly 10 receives a male blade terminal 32. It is noted in FIG. 11, that, in cross-section, the male blade terminal 32 contacts the first and second protrusions 16*b*2, 16*c*2, 16*b*4 and 16*c*4. Since a thickness TMT of the male terminal is larger than the distance d1 discussed above, male terminal compression forces are applied along the lines of contact by the first and second protrusions 16*b*2, 16*c*2, 16*b*4 and 16*c*4 thereby releasably retaining the male blade terminal 32 in the generally U-shaped channel 18.

A second exemplary embodiment of a female terminal assembly 110 of the present invention is illustrated in FIGS. 12-15. The second exemplary embodiment of the female terminal assembly 110 is similar to the first exemplary embodiment of the female terminal assembly 10 described above. However, there are distinguishing features between the two exemplary embodiments.

Although not by way of limitation but by example only, one of the pair of side members, particularly, side member 16*b*, includes a plurality of prong elements 16*b*1*p* through 16*b*1*xp* where "x" could be any integer greater than 1. However, for example purposes only, "x" is equal to the integer 4. Also, although not by way of limitation but by example only, one of the pair of clip part side members, namely, clip part side member 22*b* includes a plurality of individual panel segments 22*b*1*p* through 22*byp* where "y" could be any integer greater than 1. For example purposes only, "y" is equal to the integer 2. Additionally, the attachment member 28 includes a folded-over element 34 attached to the first panel 28*a*. The folded-over element 34 is captured by an upper portion of the C-clamp piece 30 in the second exemplary embodiment of the female terminal assembly 110.

Also, the generally U-shaped clip part 14 of the second exemplary embodiment of the female terminal assembly 110 includes a stop element 36 and a folded-back element 38. The folded-back element 38 is connected to one of the pair of the clip part side members, namely, clip part side member 22*b*2 and extends transversely and first longitudinally forwardly and then folded backwardly. The stop element 36 is connected to the clip part base member 22*a* and extends laterally and first longitudinally forwardly and then folded toward the generally U-shaped clip part channel 24.

Figure 16:
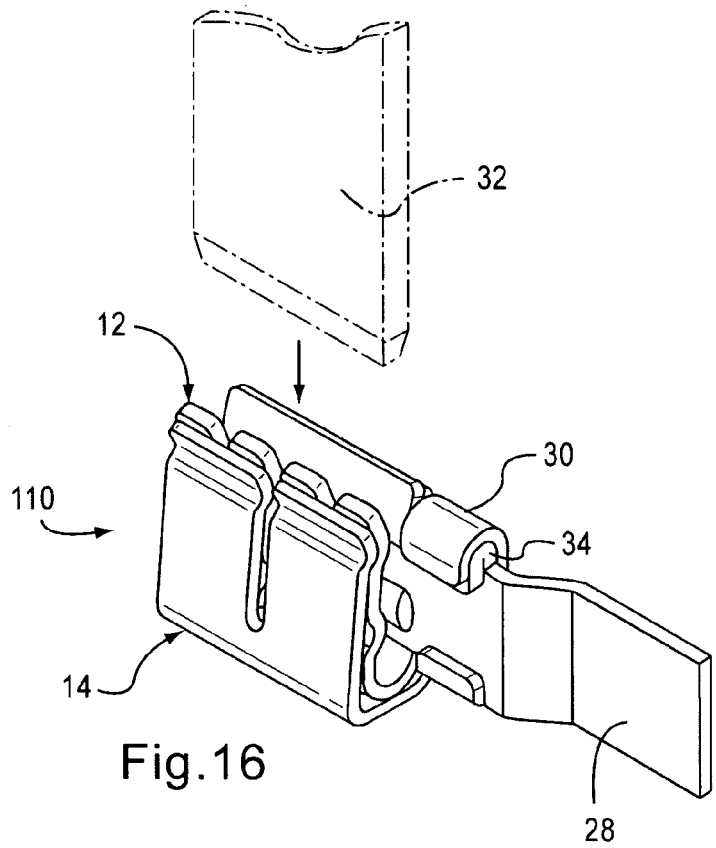
FIG. 16 is a reverse perspective view of the second exemplary embodiment of the female terminal assembly of the present invention illustrating the core terminal part and the generally U-shaped clip part releasably connected to each other just prior to receiving a conventional male terminal blade drawn in phantom.
Figure 17:
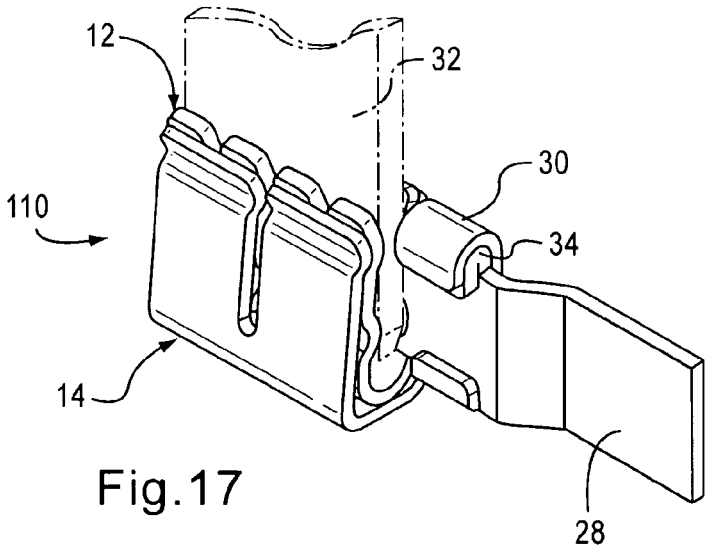
FIG. 17 is a reverse perspective view of the second exemplary embodiment of the female terminal assembly of the present invention illustrating the core terminal part and the generally U-shaped clip part releasably connected to each other with the conventional male terminal blade drawn in phantom received therein.

FIGS. 16 and 17 illustrate the female terminal assembly 110 receiving the male blade terminal 32.

Figure 18:
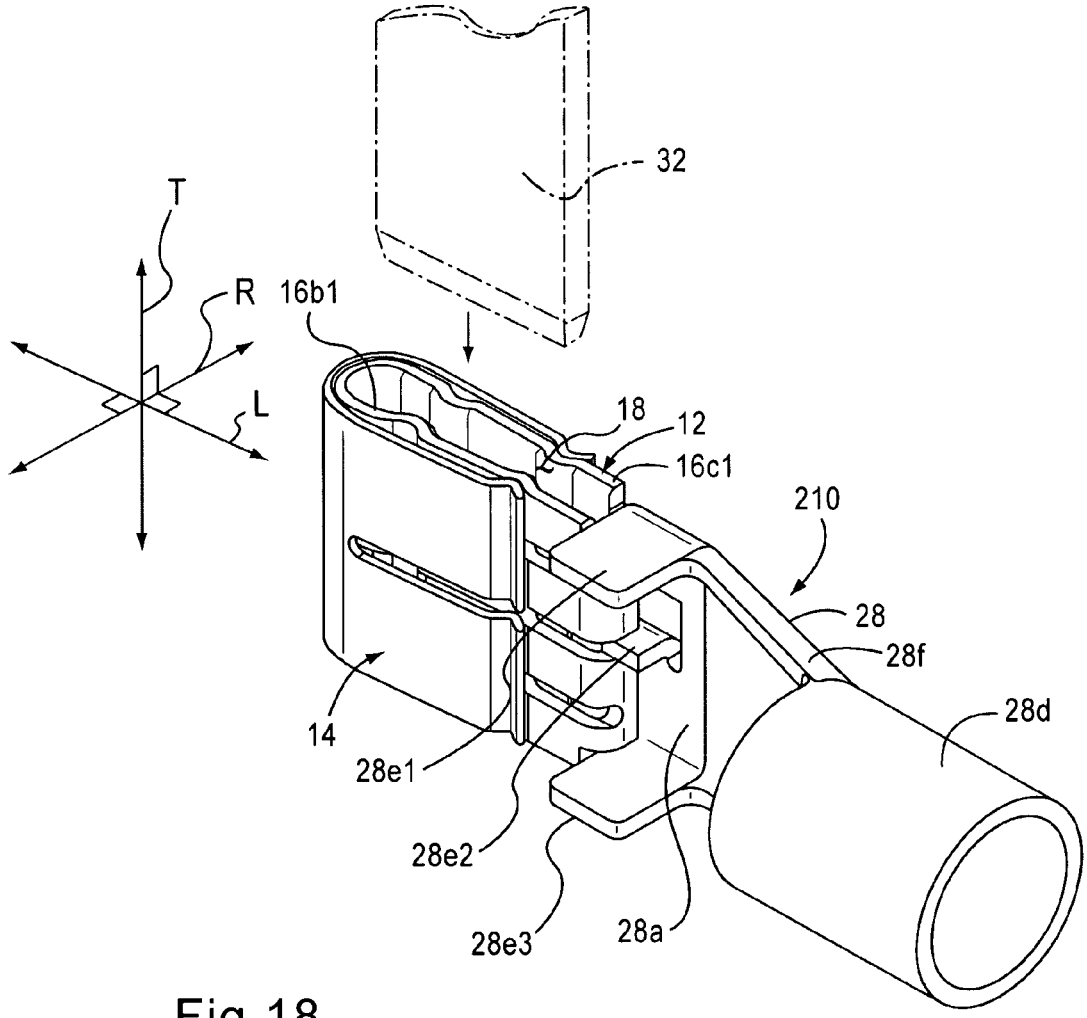
FIG. 18 is a reverse perspective view of a third exemplary embodiment of the female terminal assembly of the present invention illustrating the core terminal part and the generally U-shaped clip part releasably connected to each other just prior to receiving a conventional male terminal blade drawn in phantom.
Figure 19:
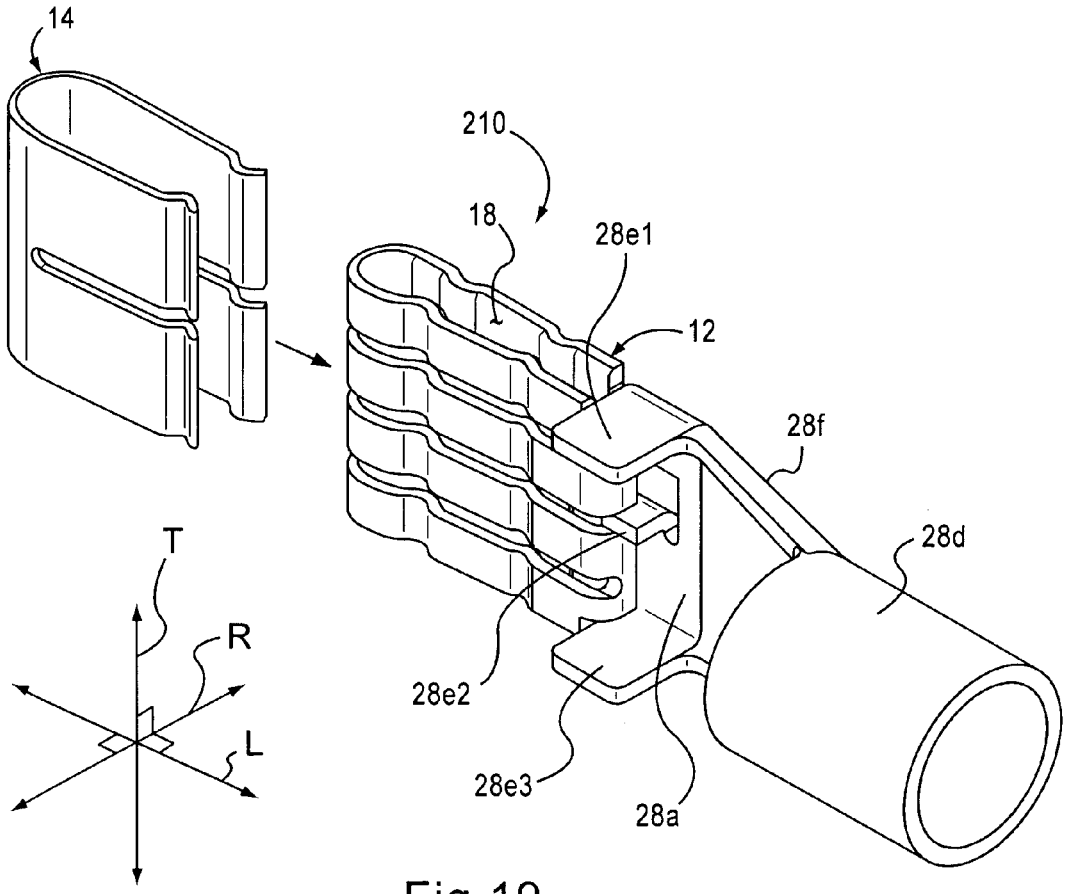
FIG. 19 is an exploded reverse perspective view of the second exemplary embodiment of the female terminal assembly of the present invention illustrating the core terminal part and the generally U-shaped clip part disengaged from each other.
Figure 20:
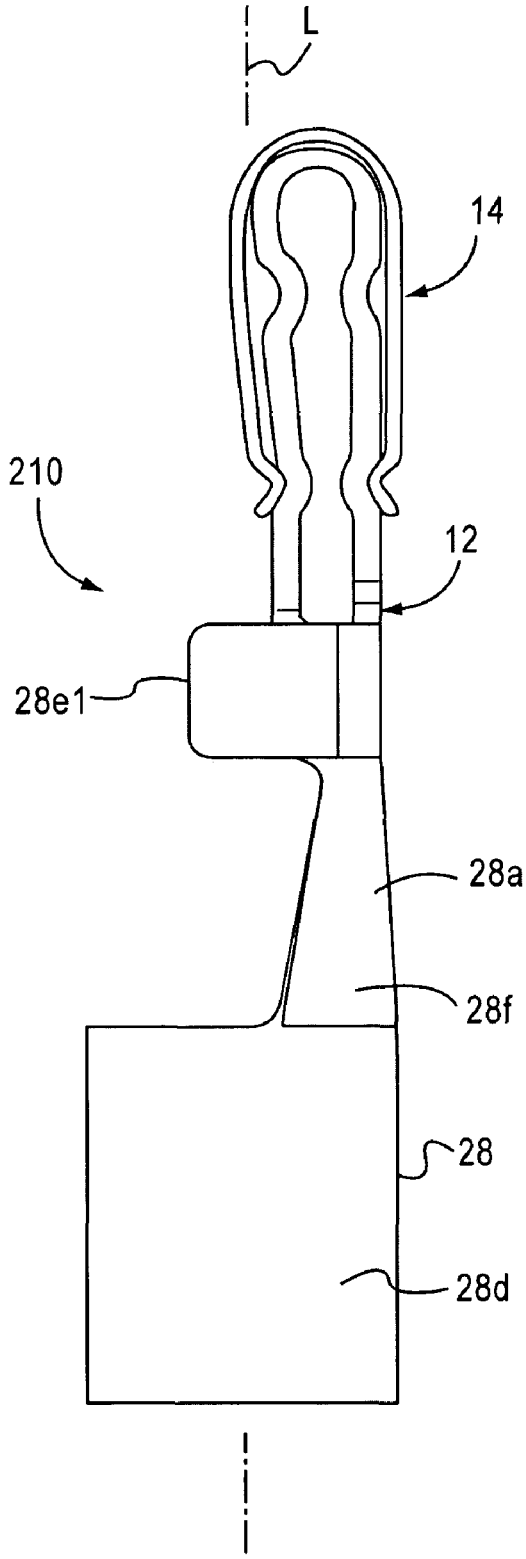
FIG. 20 is a top plan view of the female terminal assembly of the present invention shown in FIG. 18.

A third exemplary embodiment of a female terminal assembly 210 is introduced in FIGS. 18-20. The third exemplary embodiment of the female terminal assembly 210 of the present invention includes the same components as the first and second exemplary embodiments of the female terminal assembly 10 and 110 described above except that the major components are oriented in a different manner and other minor components are either modified or added thereto. The core terminal part 12 includes a longitudinally-extending generally U-shaped channel member 16 that defines a transversely-extending generally U-shaped channel 18. The generally U-shaped channel member 16 has a base member 16*a* that extends transversely and laterally and a pair of side members 16*b* and 16*c* that extend longitudinally, transversely and generally parallel to one another. The pair of side members 16*b* and 16*c* are disposed laterally apart from one another, are connected transversely along the base member 16*a* and extend longitudinally therefrom to terminate in transversely-extending respective side member end portions 16*b*1 and 16*c*1.

Further, the generally U-shaped clip part 14 includes a longitudinally-extending generally U-shaped clip part channel member 22 that defines a transversely-extending generally U-shaped clip part channel 24. The generally U-shaped clip part 14 is sized to substantially cover the generally U-shaped channel member 16 and is operative to apply opposing compression forces F1 and F2 to the respective side member end portions 16*b*1 and 16*c*1 thereby urging the pair of side members 16*b* and 16*c* towards each other and into the generally U-shaped channel 18.

The attachment member 28 includes a longitudinally-extending sleeve 28*d*. Also, the first panel 28*a* is connected to and between the one of the respective side member end portions, namely, side member end portion 16*c*1, and the sleeve 28*d*. The attachment member 28 also includes at least three longitudinally and transversely-extending stop pieces 28*e*1, 28*e*2 and 28*e*3 that are that connected to and extend laterally from the first panel 28*a*. Each one of the at least three stop pieces 28*e*1, 28*e*2 and 28*e*3 span laterally across the generally U-shaped channel 18. Further, the attachment member 28 includes a longitudinally and transversely-extending bridge element 28*f* that interconnects the first panel 28*a* and the sleeve 28*d*. Note that the bridge element 28*f* tapers from the first panel and 28*a* towards the sleeve 28*d*.

Figure 21:
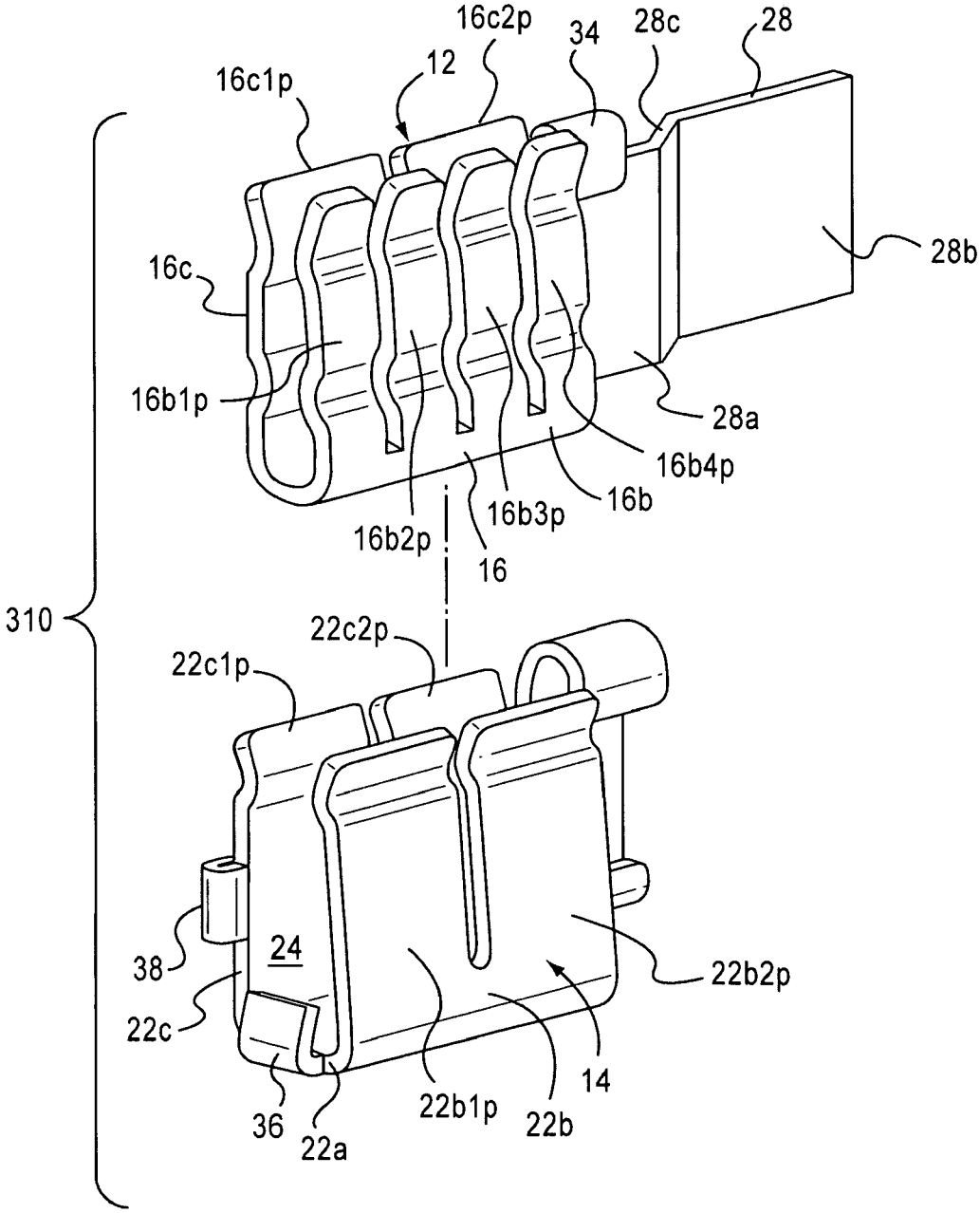
FIG. 21 is an exploded perspective view of a fourth exemplary embodiment of the female terminal assembly of the present invention illustrating the core terminal part and the generally U-shaped clip part disengaged from one another.

A fourth exemplary embodiment of a female terminal assembly 310 of the present invention is illustrated in FIG. 21. The fourth exemplary embodiment of the female terminal assembly 310 is similar to the second exemplary embodiment of the female terminal assembly 110 described above. However, there are distinguishing features between the two exemplary embodiments.

Although not by way of limitation but by example only, one of the pair of side members, specifically, side member 16*b*, includes four (4) prong elements 16*b*1*p* through 16*b*4*p* and the remaining one of the pair of side members, specifically, side member 16*c*, includes two (2) prong elements 16*c*1*p* and 16*c*2*p*. Also, although not by way of limitation but by example only, one of the pair of clip part side members, namely, clip part side member 22*b* includes two (2) individual panel segments 22*b*1*p* and 22*b*2*p* and the remaining one of the pair of clip part side members, namely, clip part side member 22*c*, also includes two (2) individual panel segments 22*c*1*p* and 22*c*2*p*.

Figure 22:
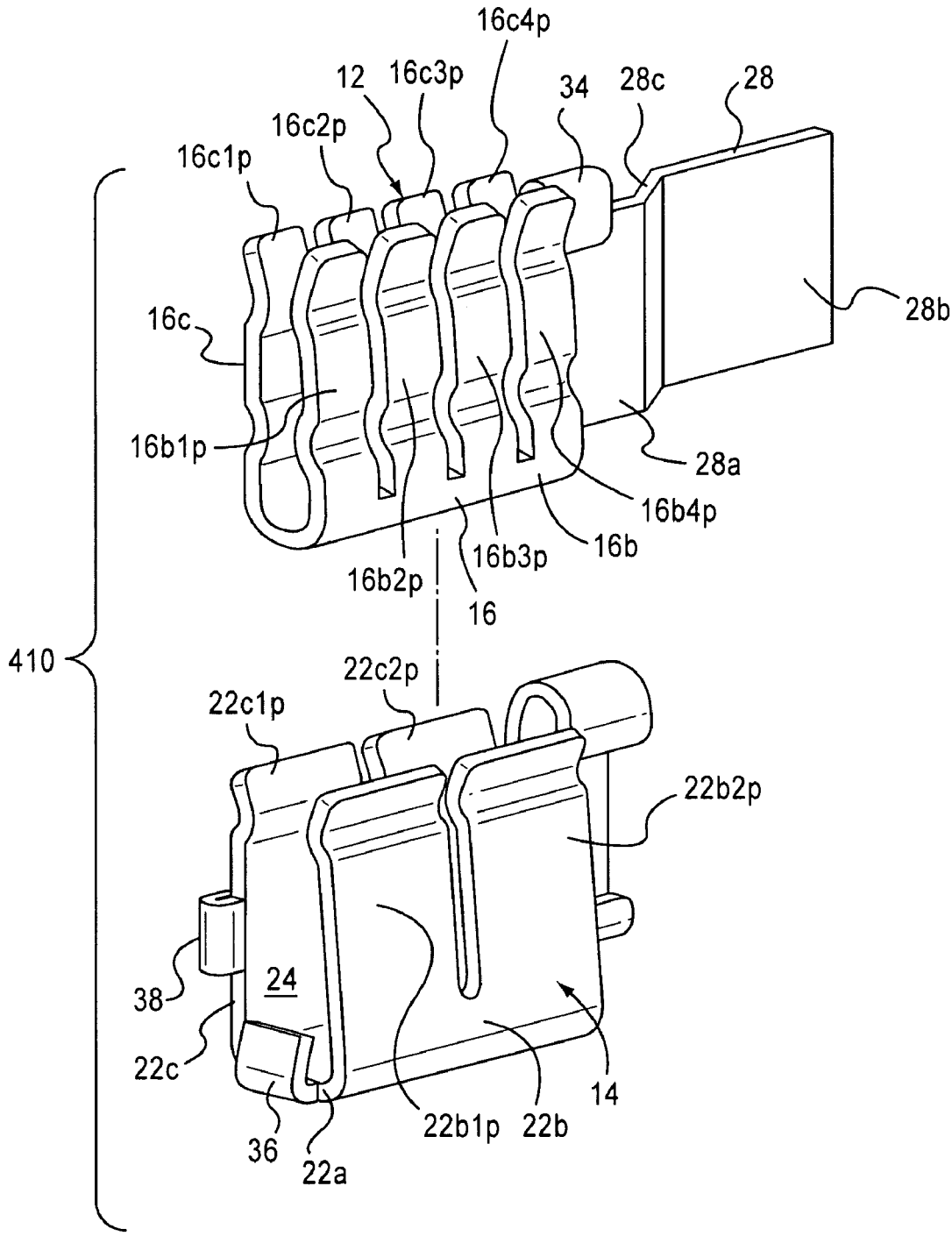
FIG. 22 is an exploded perspective view of the fifth exemplary embodiment of the female terminal assembly of the present invention illustrating the core terminal part and the generally U-shaped clip part disengaged from one another.

A fifth exemplary embodiment of a female terminal assembly 410 of the present invention is illustrated in FIG. 22. The fifth exemplary embodiment of the female terminal assembly 410 is similar to the second exemplary embodiment of the female terminal assembly 110 described above. However, there are distinguishing features between the two exemplary embodiments.

Although not by way of limitation but by example only, one of the pair of side members, specifically, side member 16*b*, includes four (4) prong elements 16*b*1*p* through 16*b*4*p* and the remaining one of the pair of side members, specifically, side member 16*c*, also includes four (4) prong elements 16*c*1*p* through 16*c*4*p*. Also, although not by way of limitation but by example only, one of the pair of clip part side members, namely, clip part side member 22*b* includes two (2) individual panel segments 22*b*1*p* and 22*b*2*p* and a remaining one of the pair of clip part side members, namely, clip part side member 22*c*, also includes two (2) individual panel segments 22*c*1*p* and 22*c*2*p*.

Figure 23:
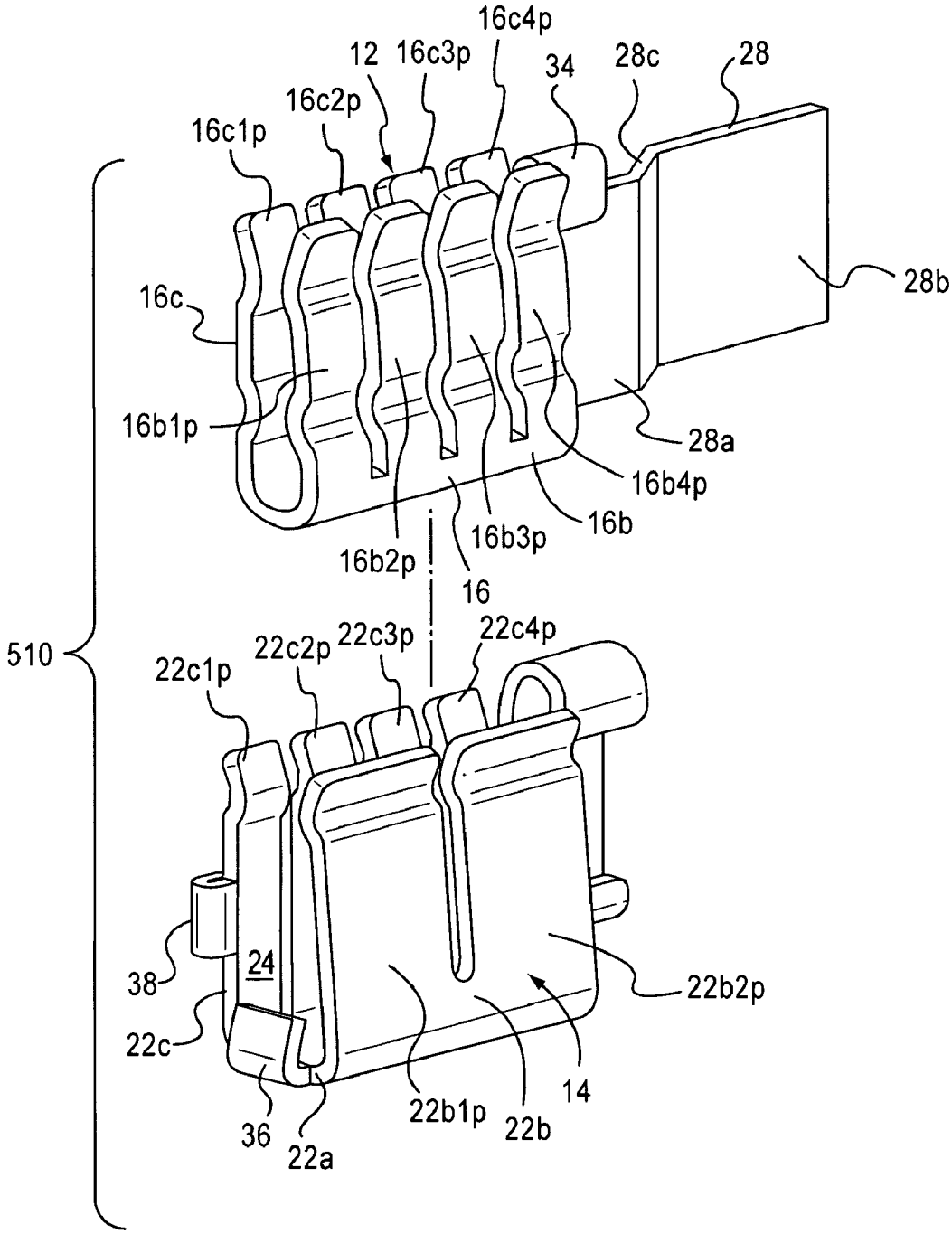
FIG. 23 is an exploded perspective view of the sixth exemplary embodiment of the female terminal assembly of the present invention illustrating the core terminal part and the generally U-shaped clip part disengaged from one another.

A sixth exemplary embodiment of a female terminal assembly 510 of the present invention is illustrated in FIG. 23. The sixth exemplary embodiment of the female terminal assembly 510 is similar to the second exemplary embodiment of the female terminal assembly 110 described above. However, there are distinguishing features between the two exemplary embodiments.

Although not by way of limitation but by example only, one of the pair of side members, specifically, side member 16*b*, includes four (4) prong elements 16*b*1*p* through 16*b*4*p* and the remaining one of the pair of side members, specifically, side member 16*c*, also includes four (4) prong elements 16*c*1*p* through 16*c*4*p*. Furthermore, although not by way of limitation but by example only, one of the pair of clip part side members, namely, clip part side member 22*b* includes two (2) individual panel segments 22*b*1*p* and 22*b*2*p* and a remaining one of the pair of clip part side members, namely, clip part side member 22*c*, includes four (4) individual panel segments 22*c*1*p* through 22*c*4*p*.

In consideration of the above, the exemplary embodiments of the female terminal assembly accept male blade terminals and provide a structure of the female terminal assembly that is particularly useful for high voltage applications.

The present invention, may, however, be embodied in various different forms and should not be construed as limited to the exemplary embodiments set forth herein; rather, these exemplary embodiments are provided so that this disclosure will be thorough and complete and will fully convey the scope of the present invention to those skilled in the art.

What is claimed is:

1. A female terminal assembly, comprising:

a core terminal part fabricated from an electrically-conductive material and including a generally U-shaped channel member defining a generally U-shaped channel extending therethough, the generally U-shaped channel member having a base member and a pair of side members extending generally parallel to one another, the pair of side members disposed apart from one another and connected to the base member to terminate in respective side member end portions defining an opening into the generally U-shaped channel facially opposing the base member; and a generally U-shaped clip part fabricated from a stiff yet resilient material and including a generally U-shaped clip part channel member defining a generally U-shaped clip part channel extending therethrough, the generally U-shaped clip part sized to substantially cover the generally U-shaped channel member and operative to apply opposing compression forces to the respective side member end portions thereby urging the pair of side members towards each other and into the generally U-shaped channel, wherein the core terminal part includes an attachment member connected to one of the pair of side members.

2. The female terminal assembly according to claim 1, wherein respective ones of the pair of side members move from a normal state to an outwardly flexed state and from the normal state to an inwardly flexed state, the respective ones of the pair of side members being resiliently biased to the normal state.

3. The female terminal assembly according to claim 1, wherein the generally U-shaped clip part channel member is sized to receive the generally U-shaped channel member in a close-fitting relationship and includes a clip part base member and a pair of clip part side members disposed apart from one another and connected to the clip part base member to terminate in respective clip part side member end portions defining a clip part opening into the generally U-shaped clip part channel facially opposing the clip part base member.

4. The female terminal assembly according to claim 3, wherein respective ones of the pair of clip part side members move from a normal condition to an outwardly flexed condition and from the normal condition state to an inwardly flexed condition, the respective ones of the pair of clip part side members being resiliently biased to the normal condition.

5. The female terminal assembly according to claim 1, wherein the generally U-shaped clip part includes a C-clamp piece connected to one of the pair of clip part side members, the C-clamp piece is sized and operative to clamp onto the attachment member.

6. The female terminal assembly according to claim 1, wherein the attachment member includes a first panel connected to one of the pair of side members and is disposed in a common plane with the one of the pair of side members.

7. The female terminal assembly according to claim 6, wherein the attachment member includes a second panel and an intermediate panel disposed between and connected to the first and second panels, the second panel being disposed in a second panel plane extending parallel to the common plane.

8. The female terminal assembly according to claim 7, wherein the intermediate panel interconnects the first and second panels and extends obliquely relative to either one of the first and second panels.

9. The female terminal assembly according to claim 6, wherein the attachment member includes a sleeve connected to the first panel with the first panel being disposed between the one of the pair of side members and the sleeve.

10. The female terminal assembly according to claim 1, wherein each one of the pair of side members includes a first protrusion projecting into the generally U-shaped channel disposed adjacent and extending parallel to the respective ones of the side member end portions and forming a corresponding first recess, the first protrusion of one of the pair of side members and the first protrusion of a remaining one of the pair of side members being facially opposed to and disposed apart from each other.

11. The female terminal assembly according to claim 10, wherein each one of the pair of side members includes a second protrusion projecting into the generally U-shaped channel disposed adjacent and extending parallel to the base member and forming a corresponding second recess, the second protrusion of one of the pair of side members and the second protrusion of a remaining one of the pair of side members being facially opposed to and disposed apart from each other.

12. The female terminal assembly according to claim 10, wherein the generally U-shaped clip part channel member includes a clip part base member and a pair of clip part side members disposed apart from one another and connected to the clip part base member to terminate in respective clip part side member end portions defining a clip part opening into the generally U-shaped clip part channel facially opposing the clip part base member, each one of the pair of clip part side members includes a clip part protrusion projecting into the generally U-shaped clip part channel disposed adjacent and extending parallel to the respective ones of the clip part side member end portions and forming a corresponding clip part recess, the clip part protrusion of one of the pair of clip part side members and the clip part protrusion of a remaining one of the pair of clip part side members being facially opposed to and disposed apart from each other.

13. The female terminal assembly according to claim 12, wherein respective ones of the clip part protrusions nestle into respective ones of the first recesses.

14. The female terminal assembly according to claim 13, wherein the base member and the clip part base member are disposed at least adjacent to each other.

15. The female terminal assembly according to claim 12, wherein the respective clip part side member end portions taper inwardly from the clip part opening and towards each other into the generally U-shaped clip part channel to form a generally V-shaped clip part channel portion as viewed in cross-section.

16. The female terminal assembly according to claim 1, wherein the respective side member end portions taper inwardly from the opening and towards each other into the generally U-shaped channel to form a generally V-shaped channel portion as viewed in cross-section.

17. A female terminal assembly according to claim 1, comprising:

a core terminal part fabricated from an electrically-conductive material and including a generally U-shaped channel member defining a generally U-shaped channel extending therethough, the generally U-shaped channel member having a base member and a pair of side members extending generally parallel to one another, the pair of side members disposed apart from one another and connected to the base member to terminate in respective side member end portions defining an opening into the generally U-shaped channel facially opposing the base member; and a generally U-shaped clip part fabricated from a stiff yet resilient material and including a generally U-shaped clip part channel member defining a generally U-shaped clip part channel extending therethrough, the generally U-shaped clip part sized to substantially cover the generally U-shaped channel member and operative to apply opposing compression forces to the respective side member end portions thereby urging the pair of side members towards each other and into the generally U-shaped channel, wherein one of the pair of side members includes a plurality of prong elements.

18. A female terminal assembly, comprising:

a core terminal part fabricated from an electrically-conductive material and including a generally U-shaped channel member defining a generally U-shaped channel extending therethough, the generally U-shaped channel member having a base member and a pair of side members extending generally parallel to one another, the pair of side members disposed apart from one another and connected to the base member to terminate in respective side member end portions defining an opening into the generally U-shaped channel facially opposing the base member; and a generally U-shaped clip part fabricated from a stiff yet resilient material and including a generally U-shaped clip part channel member defining a generally U-shaped clip part channel extending therethrough, the generally U-shaped clip part sized to substantially cover the generally U-shaped channel member and operative to apply opposing compression forces to the respective side member end portions thereby urging the pair of side members towards each other and into the generally U-shaped channel, wherein one of the pair of clip part side members includes a plurality of individual panel segments.

19. A female terminal assembly, comprising:

a core terminal part fabricated from an electrically-conductive material and including a longitudinally-extending generally U-shaped channel member defining a longitudinally-extending generally U-shaped channel, the generally U-shaped channel member having a base member extending longitudinally and laterally and a pair of side members extending longitudinally, transversely and generally parallel to one another, the pair of side members disposed laterally apart from one another, connected longitudinally along the base member and extending transversely therefrom to terminate in respective side member end portions defining a longitudinally and laterally extending opening into the generally U-shaped channel facially opposing the base member; and a generally U-shaped clip part fabricated from a stiff yet resilient material and including a longitudinally-extending generally U-shaped clip part channel member defining a longitudinally-extending generally U-shaped clip part channel, the generally U-shaped clip part sized to substantially cover the generally U-shaped channel member and operative to apply opposing compression forces to the respective side member end portions thereby urging the pair of side members towards each other and into the generally U-shaped channel, wherein each one of the pair of side members includes a first protrusion projecting into the generally U-shaped channel disposed adjacent and extending parallel to the respective ones of the side member end portions and forming a corresponding first recess, the first protrusion of one of the pair of side members and the first protrusion of a remaining one of the pair of side members being facially opposed to and disposed apart from each other, each one of the pair of side members includes a second protrusion projecting into the generally U-shaped channel disposed adjacent and extending parallel to the base member and forming a corresponding second recess, the second protrusion of one of the pair of side members and the second protrusion of a remaining one of the pair of side members being facially opposed to and disposed apart from each other, the generally U-shaped clip part channel member includes a clip part base member and a pair of clip part side members disposed apart from one another and connected to the clip part base member to terminate in respective clip part side member end portions defining a clip part opening into the generally U-shaped clip part channel facially opposing the clip part base member, each one of the pair of clip part side members includes a clip part protrusion projecting into the generally U-shaped clip part channel disposed adjacent and extending parallel to the respective ones of the clip part side member end portions and forming a corresponding clip part recess, the clip part protrusion of one of the pair of clip part side members and the clip part protrusion of a remaining one of the pair of clip part side members being facially opposed to and disposed apart from each other, respective ones of the clip part protrusions nestle into respective ones of the first recesses, and wherein the generally U-shaped clip part includes a folded-back element and a stop element, the folded-back element is connected to one of the pair of the clip part side members to extend transversely and first longitudinally forwardly and then folded backwardly, the stop element is connected to the clip part base member to extend laterally and first longitudinally forwardly and then folded toward the generally U-shaped clip part channel.

20. The female terminal assembly according to claim 19, wherein respective ones of the pair of side members move from a normal state to an outwardly flexed state and from the normal state to an inwardly flexed state, the respective ones of the pair of side members being resiliently biased to the normal state, the generally U-shaped clip part channel member is sized to receive the generally U-shaped channel member in a close-fitting relationship and includes a clip part base member and a pair of clip part side members disposed apart from one another and connected to the clip part base member to terminate in respective clip part side member end portions defining a clip part opening into the generally U-shaped clip part channel facially opposing the clip part base member and respective ones of the pair of clip part side members move from a normal condition to an outwardly flexed condition and from the normal condition state to an inwardly flexed condition, the respective ones of the pair of clip part side members being resiliently biased to the normal condition.

21. A female terminal assembly, comprising:

a core terminal part fabricated from an electrically-conductive material and including a longitudinally-extending generally U-shaped channel member defining a longitudinally-extending generally U-shaped channel, the generally U-shaped channel member having a base member extending longitudinally and laterally and a pair of side members extending longitudinally, transversely and generally parallel to one another; the pair of side members disposed laterally apart from one another, connected longitudinally along the base member and extending transversely therefrom to terminate in respective side member end portions defining a longitudinally and laterally extending opening into the generally U-shaped channel facially opposing the base member; and a generally U-shaped clip part fabricated from a stiff yet resilient material and including a longitudinally-extending generally U-shaped clip part channel member defining a longitudinally-extending generally U-shaped clip part channel, the generally U-shaped clip part sized to substantially cover the generally U-shaped channel member and operative to apply opposing compression forces to the respective side member end portions thereby urging the pair of side members towards each other and into the generally U-shaped channel, wherein respective ones of the pair of side members move from a normal state to an outwardly flexed state and from the normal state to an inwardly flexed state, the respective ones of the pair of side members being resiliently biased to the normal state, the generally U-shaped clip part channel member is sized to receive the generally U-shaped channel member in a close-fitting relationship and includes a clip part base member and a pair of clip part side members disposed apart from one another and connected to the clip part base member to terminate in respective clip part side member end portions defining a clip part opening into the generally U-shaped clip part channel facially opposing the clip part base member and respective ones of the pair of clip part side members move from a normal condition to an outwardly flexed condition and from the normal condition state to an inwardly flexed condition, the respective ones of the pair of clip part side members being resiliently biased to the normal condition, and wherein at least one of the pair of side members is formed as a plurality of prong elements and at least one of the pair of clip part side members is formed as a plurality of individual panel segments.

22. The female terminal assembly according to claim 21, wherein each one of the pair of side members includes a first protrusion projecting into the generally U-shaped channel disposed adjacent and extending parallel to the respective ones of the side member end portions and forming a corresponding first recess, the first protrusion of one of the pair of side members and the first protrusion of a remaining one of the pair of side members being facially opposed to and disposed apart from each other, each one of the pair of side members includes a second protrusion projecting into the generally U-shaped channel disposed adjacent and extending parallel to the base member and forming a corresponding second recess, the second protrusion of one of the pair of side members and the second protrusion of a remaining one of the pair of side members being facially opposed to and disposed apart from each other, the generally U-shaped clip part channel member includes a clip part base member and a pair of clip part side members disposed apart from one another and connected to the clip part base member to terminate in respective clip part side member end portions defining a clip part opening into the generally U-shaped clip part channel facially opposing the clip part base member, each one of the pair of clip part side members includes a clip part protrusion projecting into the generally U-shaped clip part channel disposed adjacent and extending parallel to the respective ones of the clip part side member end portions and forming a corresponding clip part recess, the clip part protrusion of one of the pair of clip part side members and the clip part protrusion of a remaining one of the pair of clip part side members being facially opposed to and disposed apart from each other, respective ones of the clip part protrusions nestle into respective ones of the first recesses.

23. A female terminal assembly, comprising:

a core terminal part fabricated from an electrically-conductive material and including a longitudinally-extending generally U-shaped channel member defining a transversely-extending generally U-shaped channel, the generally U-shaped channel member having a base member extending transversely and laterally and a pair of side members extending longitudinally, transversely and generally parallel to one another, the pair of side members disposed laterally apart from one another, connected transversely along the base member and extending longitudinally therefrom to terminate in transversely-extending respective side member end portions; and a generally U-shaped clip part fabricated from a stiff yet resilient material and including a longitudinally-extending generally U-shaped clip part channel member defining a transversely-extending generally U-shaped clip part channel, the generally U-shaped clip part sized to substantially cover the generally U-shaped channel member and operative to apply opposing compression forces to the respective side member end portions thereby urging the pair of side members towards each other and into the generally U-shaped channel, wherein the core terminal part includes an attachment member connected to one of the respective side member end portions.

24. The female terminal assembly according to claim 23, wherein each one of the pair of side members includes a first protrusion projecting into the generally U-shaped channel disposed adjacent and extending parallel to the respective ones of the side member end portions and forming a corresponding first recess, the first protrusion of one of the pair of side members and the first protrusion of a remaining one of the pair of side members being facially opposed to and disposed apart from each other, each one of the pair of side members includes a second protrusion projecting into the generally U-shaped channel disposed adjacent and extending parallel to the base member and forming a corresponding second recess, the second protrusion of one of the pair of side members and the second protrusion of a remaining one of the pair of side members being facially opposed to and disposed apart from each other, the generally U-shaped clip part channel member includes a clip part base member and a pair of clip part side members disposed apart from one another and connected to the clip part base member to terminate in respective clip part side member end portions defining a clip part opening into the generally U-shaped clip part channel facially opposing the clip part base member, each one of the pair of clip part side members includes a clip part protrusion projecting into the generally U-shaped clip part channel disposed adjacent and extending parallel to the respective ones of the clip part side member end portions and forming a corresponding clip part recess, the clip part protrusion of one of the pair of clip part side members and the clip part protrusion of a remaining one of the pair of clip part side members being facially opposed to and disposed apart from each other, respective ones of the clip part protrusions nestle into respective ones of the first recesses.

25. The female terminal assembly according to claim 23, wherein the attachment member includes a longitudinally-extending sleeve and a first panel connected to and between the one of the respective side member end portions and the sleeve.

26. The female terminal assembly according to claim 25, wherein the attachment member includes at least three longitudinally and transversely-extending stop pieces connected to and extending laterally from the first panel, each one of the at least three stop pieces spanning laterally across the U-shaped channel.

27. The female terminal assembly according to claim 26, wherein the attachment member includes a longitudinally and transversely-extending bridge element interconnecting the first panel and the sleeve, the bridge element tapering from the first panel and towards the sleeve.

* * * * *